US010684576B2

(12) United States Patent
Shimura et al.

(10) Patent No.: US 10,684,576 B2
(45) Date of Patent: Jun. 16, 2020

(54) IMAGE FORMING APPARATUS HAVING MONOCHROME MODE AND COLOR MODE

(71) Applicant: CANON KABUSHIKI KAISHA, Tokyo (JP)

(72) Inventors: Hiromi Shimura, Toride (JP); Hiroto Nishihara, Tsukuba (JP); Teruhito Kai, Abiko (JP); Keita Takahashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/255,138

(22) Filed: Jan. 23, 2019

(65) Prior Publication Data

US 2019/0235419 A1 Aug. 1, 2019

(30) Foreign Application Priority Data

Feb. 1, 2018 (JP) ..... 2018-016694

(51) Int. Cl.
*G03G 15/16* (2006.01)
*G03G 15/01* (2006.01)

(52) U.S. Cl.
CPC ..... *G03G 15/161* (2013.01); *G03G 15/0131* (2013.01); *G03G 15/0136* (2013.01)

(58) Field of Classification Search
CPC ..... G03G 15/161
See application file for complete search history.

(56) References Cited

U.S. PATENT DOCUMENTS 8,620,193 B2 12/2013 Yamamoto et al.
9,324,010 B2 4/2016 Iwadate et al.
9,423,725 B2 8/2016 Yamauchi
9,547,266 B2 1/2017 Nihei
9,952,530 B2 4/2018 Kubo
10,031,450 B2 7/2018 Sakaguchi et al.
10,181,095 B2 1/2019 Takahashi et al.
10,191,424 B2 1/2019 Shimura et al.
2014/0119760 A1 5/2014 Ju
2017/0068196 A1* 3/2017 Ujike ..... G03G 15/0189

FOREIGN PATENT DOCUMENTS

JP 4164503 B2 10/2008
JP 2016-021048 A 2/2016
JP 2016-051019 A 4/2016
JP 2016-206599 A 12/2016
JP 2017-053927 A 3/2017

OTHER PUBLICATIONS

Machine translation of Office Action dated Jan. 7, 2020 in Japanese Application No. 2018-016694 (2020).*

* cited by examiner

*Primary Examiner* — Sevan A Aydin
(74) *Attorney, Agent, or Firm* — Venable LLP

(57) ABSTRACT

In a case where a controller executes formation of a first image which is a monochrome image, a second image which is a monochrome image, a third image which is a color image, and a fourth image which is a color image in order, the controller forms the first image by one image formation unit while other image forming units are in a separated state, and controls a mechanism to switch to a contact state after the formation of the first image completes and transfer to a sheet by an intermediate transfer member completes, and prior to starting formation of the second image. The controller forms the second image by the one image formation unit and forms the third image by one of the other image formation units.

11 Claims, 7 Drawing Sheets

IMAGE FORMING APPARATUS HAVING MONOCHROME MODE AND COLOR MODE

BACKGROUND OF THE INVENTION

Field of the Invention

The present invention relates to an image forming apparatus having a monochrome mode and a color mode.

Description of the Related Art

An image forming apparatus forms a color image by using an intermediate transfer member and a plurality of photoconductive drums that carry toner images each of different colors. Generally, because a monochrome mode is more frequently used than a color mode, in the monochrome mode, the intermediate transfer member is separated from a plurality of photoconductive drums on which toner images of colors other than black are formed. By this, the life span of the plurality of photoconductive drums on which toner images of colors other than black are formed is extended.

Incidentally, when transitioning from the monochrome mode to the color mode, it is necessary for the intermediate transfer member and the plurality of photoconductive drums on which toner images of colors other than black are formed to transition from a separated state to a contact state. Color misregistration or image unevenness may occur due to vibration and the like accompanying such a contact operation. According to Japanese Patent No. 4164503, a contact operation is executed in a period in which image formation is not being executed on photoconductive drums and a transfer of an image from the intermediate transfer member to a sheet is being executed.

In a job for forming two color images after two monochrome images are formed, generally, a contact operation is executed after the two monochrome images are transferred to sheets. In the method of Japanese Patent No. 4164503, the contact operation is executed after the first monochrome image is transferred to the intermediate transfer member and the second monochrome image is formed in the color mode. By this, the execution time of a job is shortened.

SUMMARY OF THE INVENTION

The present invention provides an image forming apparatus operable to form an image on a sheet. The apparatus may comprise the following elements. A first image formation unit forms a toner image by toner of a first color. A second image formation unit forms a toner image by toner of a second color. A third image formation unit forms a toner image by toner of a third color. A fourth image formation unit forms a toner image by toner of a fourth color. An intermediate transfer member, onto which toner images formed by each of the first image formation unit, the second image formation unit, the third image formation unit, and the fourth image formation unit are transferred, conveys the toner images to a transfer position at which the toner images are transferred to a sheet. A contact and separation mechanism switches a contact state in which the intermediate transfer member is in contact with the first image formation unit, the second image formation unit, and the third image formation unit and a separated state in which the intermediate transfer member is separated from the first image formation unit, the second image formation unit, and the third image formation unit. A controller controls the first image formation unit, the second image formation unit, the third image formation unit, the fourth image formation unit, and the contact and separation mechanism. The first image formation unit is provided most upstream with respect to a direction in which the toner images are conveyed by the intermediate transfer member. The second image formation unit is provided downstream of the first image formation unit in the direction. The third image formation unit is provided downstream of the second image formation unit in the direction. The fourth image formation unit is provided downstream of the third image formation unit in the direction. In a case in which the controller executes formation of a first image which is a monochrome image, a second image which is a monochrome image, a third image which is a color image, and a fourth image which is a color image in order on sheets, the controller executes formation of the first image by the fourth image formation unit in the separated state, controls the contact and separation mechanism to switch to the contact state after formation of the first image completes and transfer to the sheet by the intermediate transfer member completes, and prior to starting formation of the second image, and executes formation of the second image by the fourth image formation unit and formation of the third image by the first image formation unit in the contact state.

Further features of the present invention will become apparent from the following description of exemplary embodiments with reference to the attached drawings.

DESCRIPTION OF THE EMBODIMENTS

<Image Forming Apparatus>

Figure 1:
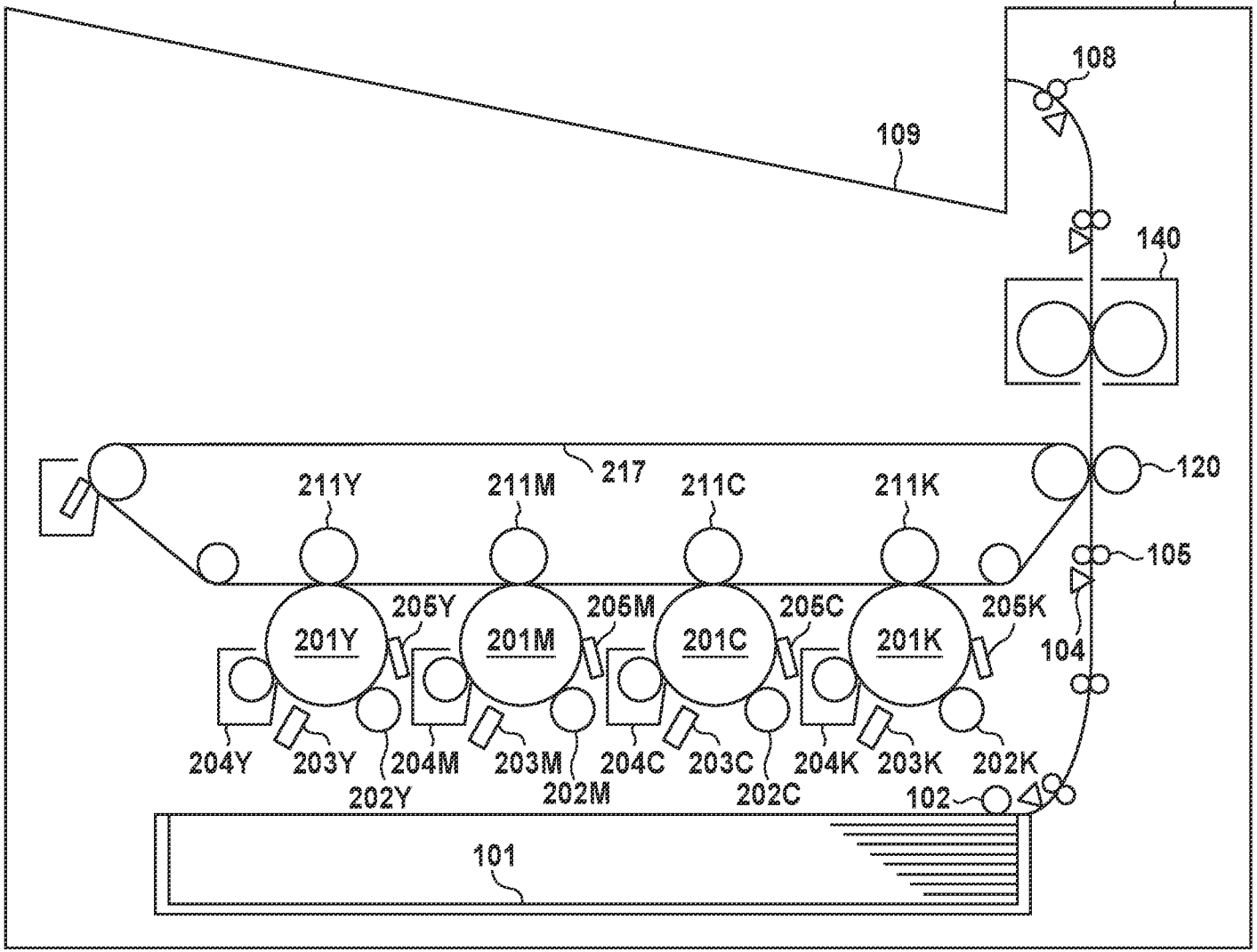
FIG. 1 is an overview cross-sectional view of an image forming apparatus.

FIG. 1 is an overview cross-sectional view of an image forming apparatus according to the present embodiment. A cassette 101 is arranged inside an image forming apparatus 100, and a storage unit for storing multiple (cut) sheets in FIG. 1. A pickup roller 102 picks up a sheet which is stored in the cassette 101 and feeds it to a conveyance path. A sheet sensor 104 is arranged on the downstream side of the pickup roller 102 in a conveyance direction of a sheet. A registration roller 105 is a conveyance roller which adjusts a timing at which a sheet reaches a secondary transfer position corresponding to a timing at which the sheet sensor 104 detects a leading edge of the sheet.

An image forming unit is composed of a photoconductive drum 201Y, a charging roller 202Y, a laser unit 203Y, a developer 204Y, and a cleaner 205Y. The photoconductive drum 201 is an image bearing member which bears an electrostatic latent image and a toner image. In FIG. 1 the characters Y, M, C, and K, which are added to the end of reference numerals, mean yellow, magenta, cyan, and black, which are toner colors. The characters indicating toner colors are omitted in a description which is common for the four colors. The charging roller 202 uniformly charges a surface of the photoconductive drum 201 by using a charging bias. The laser unit 203 is an exposure apparatus or an optical scanning apparatus which forms an electrostatic latent image by irradiating a laser beam onto the surface of the photoconductive drum 201, which is charged uniformly. The developer 204 develops a toner image by adhering toner to the electrostatic latent image using a developing bias. A contact portion (a nipping portion) of a primary transfer roller 211 and the photoconductive drum 201 is referred to as a primary transfer unit or a primary transfer position. The primary transfer roller 211 transfers a toner image to a transfer belt 217 using a primary transfer bias. In a job in which a monochrome image is formed on a sheet, a black toner image is transferred from the photoconductive drum 201K onto the transfer belt 217. In a job in which a color image is formed on a sheet, each toner image of Y, M, C, and K is transferred in order from photoconductive drums 201Y, 201M, 201C, and 201K to the transfer belt 217. The cleaner 205 cleans the toner remaining on the photoconductive drum 201.

The transfer belt 217 conveys the toner image to the secondary transfer unit (secondary transfer position) while rotating. The secondary transfer unit is a contact portion (nipping portion) between the transfer belt 217 and a secondary transfer roller 120. The secondary transfer unit transfers a toner image to a sheet by using a secondary transfer bias. A fixer 140 fixes the toner image to the sheet by applying heat and pressure to the toner image and sheet. A discharge roller 108 discharges the sheet to a tray 109.

<Monochrome Mode and Color Mode (Separated State and Contact State)>

Figure 2A:
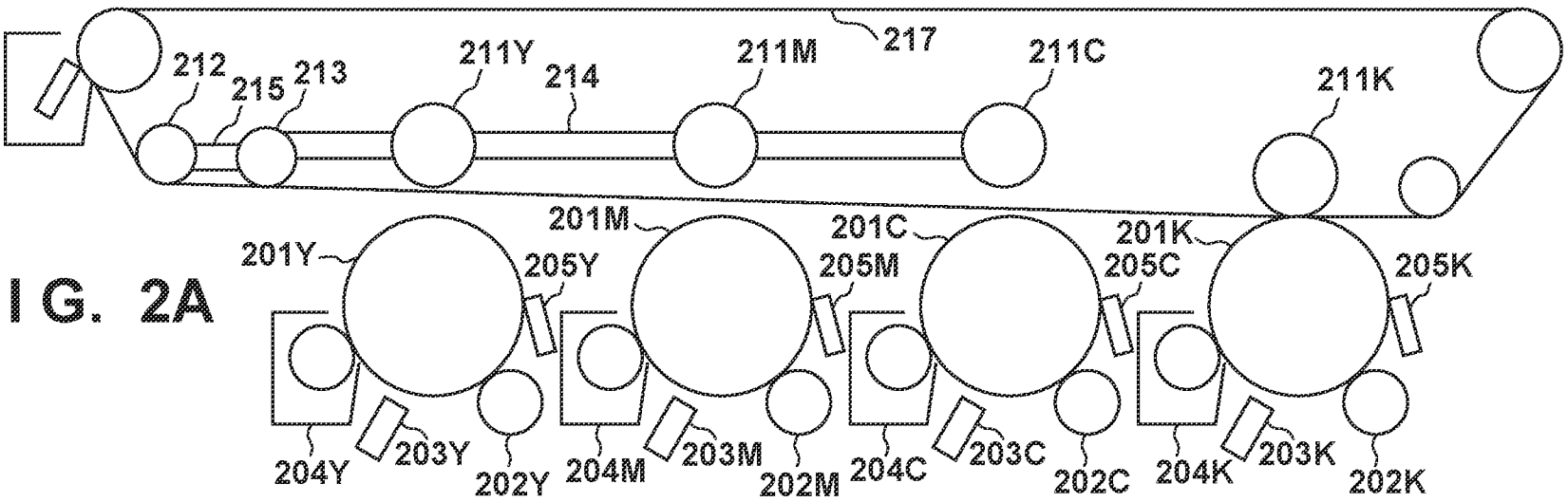
FIGS. 2A and 2B are views for illustrating a contact and separation mechanism of a transfer belt.

FIG. 2A illustrates the position of the transfer belt 217 in the monochrome mode. In the monochrome mode, the photoconductive drums 201Y, 201M, and 201C are separated from the transfer belt 217 in order to reduce wear-and-tear of the photoconductive drums 201Y, 201M, and 201C. A positioning member 214 is a member for aligning the primary transfer rollers 211Y, 211M, and 211C. A positioning member 215 is a member for aligning the tension rollers 212 and 213. As FIG. 2A illustrates, in the monochrome mode, the primary transfer rollers 211Y, 211M, and 211C are raised by the positioning members 214 and 215 moving to a separated position. By this, the transfer belt 217 separates from the photoconductive drums 201Y, 201M, and 201C. Note, the photoconductive drum 201K remains in contact with the transfer belt 217.

Figure 2B:
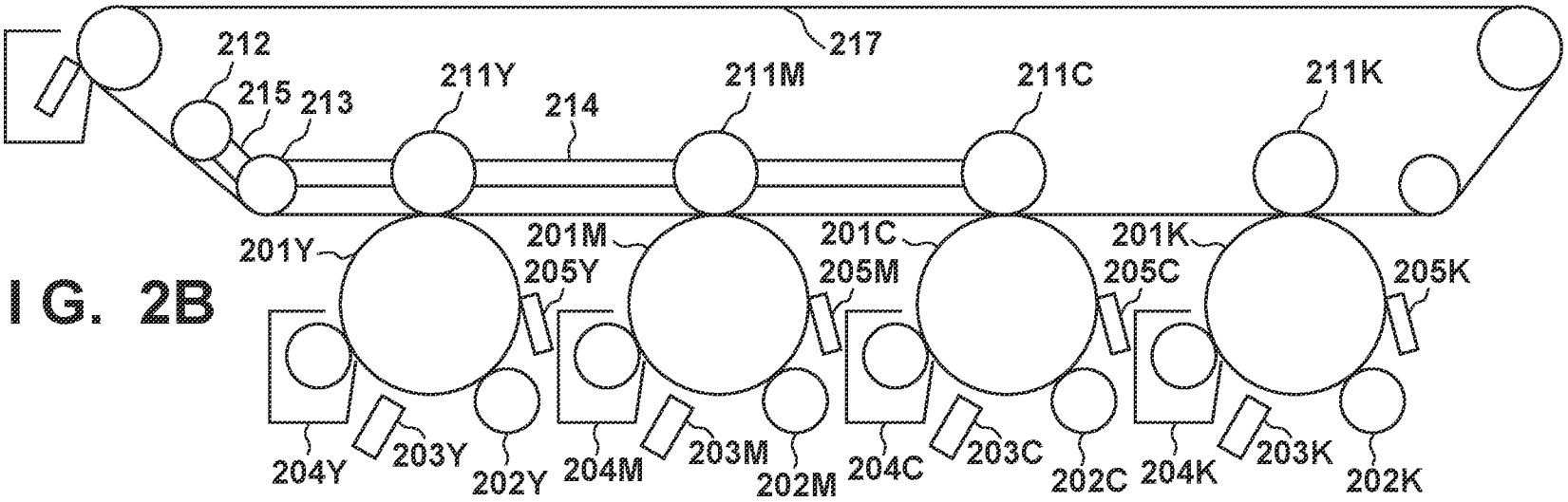

FIG. 2B illustrates the position of the transfer belt 217 in the color mode. In the color mode, the primary transfer rollers 211Y, 211M, and 211C are lowered by the positioning members 214 and 215 moving to a contact position. By this, the transfer belt 217 contacts from the photoconductive drums 201Y, 201M, and 201C. Note, the time necessary for transitioning from the separated state to the contact state is called the contact time Ts. As an example, the contact time Ts is 900 milliseconds.

<Controller>

Figure 3:
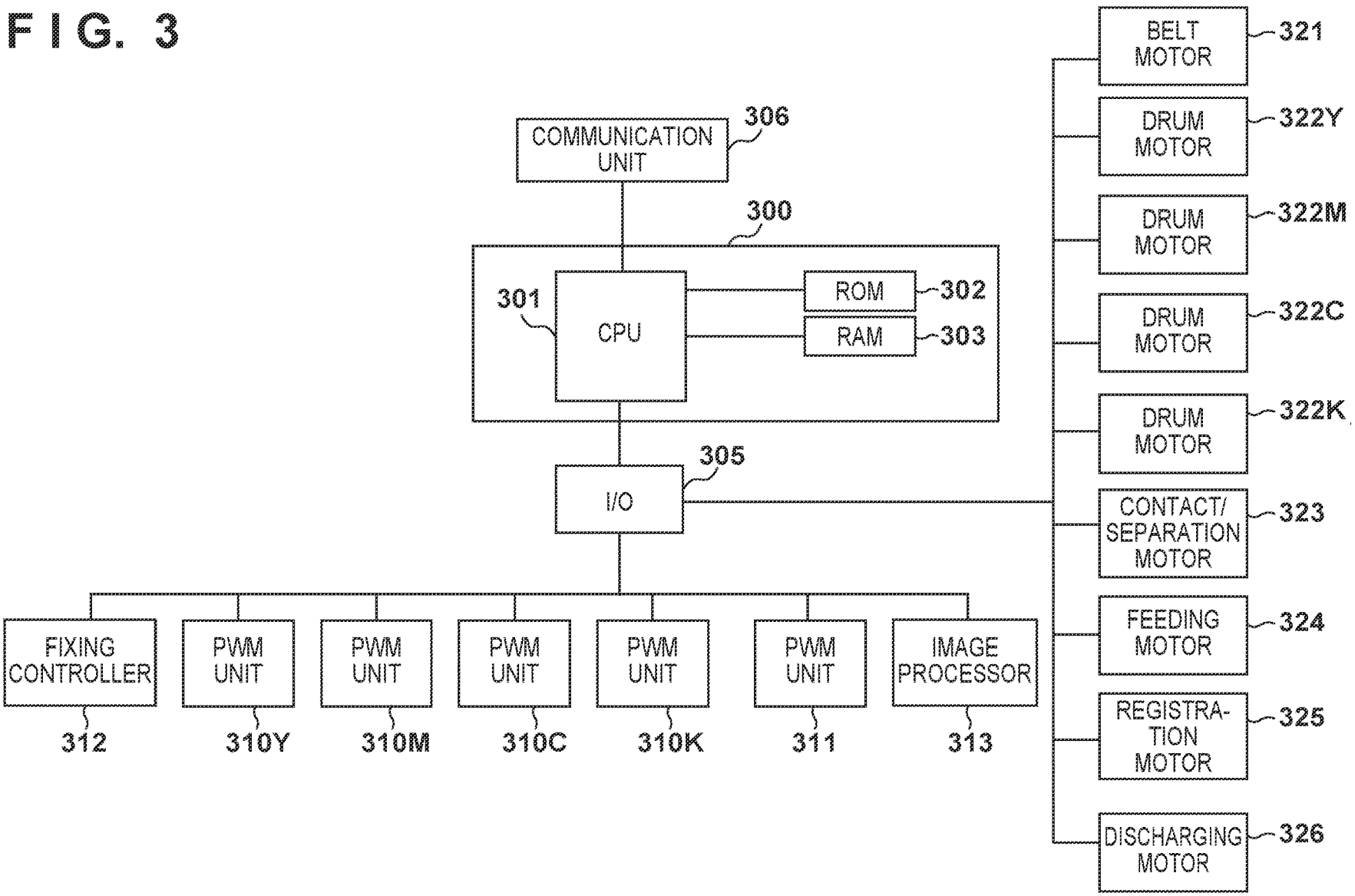
FIG. 3 is a block diagram for illustrating a controller.

FIG. 3 is a view for describing a controller 300 of the image forming apparatus 100. The controller 300 has a CPU 301, a ROM 302, and a RAM 303. The CPU 301 controls the image forming unit and the like in accordance with a control program stored in the ROM 302. The RAM 303 is a memory for storing flags, variables, and the like. A communication unit 306 is a communication circuit for communicating with a host computer. The CPU 301 starts a print operation when it receives a print instruction (job) via the communication unit 306. The CPU 301 controls various loads involving image formation via an I/O 305. The CPU 301 causes the pickup roller 102 to rotate by driving a feeding motor 324. Also, by causing a similar registration motor 325 to be driven, the registration roller 105 is caused to rotate. Additionally, the CPU 301 rotates the discharge roller 108 and the fixing roller within the fixer 140 by driving a discharging motor 326. The CPU 301 rotates the photoconductive drum 201, the charging roller 202, and the developer 204, whose driving source is the drum motor 322, by driving the drum motor 322 via the I/O 305. The CPU 301 rotates the primary transfer roller 211 and the tension rollers 212 and 213, whose driving source is the belt motor 321, by driving the belt motor 321 via the I/O 305. Also, the transfer belt 217 rotates in conjunction with the rotation of this group of rollers. The CPU 301, by driving a contact/separation motor 323 via the I/O 305, moves the positioning members 214 and 215, whose driving source is the contact/separation motor 323, to the contact position or to the separated position. The contact/separation motor 323 is capable of forward rotation and backward rotation, and in accordance with the rotation direction, movement to the contact position and movement to the separated position is switched. The CPU 301, via the I/O 305, makes an instruction to a PWM unit 310. The PWM unit 310 controls the voltage applied to the charging roller 202, the developer 204, and the primary transfer roller 211 by the PWM control, and the laser beam amount of the laser unit 203. Furthermore, the CPU 301 controls the voltage (secondary transfer bias) applied to the secondary transfer roller 120 by a PWM unit 311. A fixing controller 312 controls a heater temperature for the fixer 140. The CPU 301, via the I/O 305, can make an instruction to an image processor 313. This instruction may be a mode designation or an image output instruction. The mode designation is an instruction for designating a monochrome mode or a color mode. When the monochrome mode is designated, the image processor 313 outputs an image signal to the laser unit 203K. When the color mode is designated, the image processor 313 outputs an image signal to the laser units 203Y to 203K.

<Basic Operations>

Contact/separation operations, a rotation operation, image formation preparation, image formation, and a secondary transfer are included in basic operations. The contact/separation operations include a contact operation in which the photoconductive drum 201 and the transfer belt 217 are made to be in contact, and a separation operation in which they are separated. The contact operation is generally executed when switching from the monochrome mode to the color mode. The separation operation is generally executed when switching from the monochrome mode to the color mode. Note that even in the color mode, in which the photoconductive drums 201Y, 201M, and 201C rotate, it is possible to form a monochrome image. The rotation operation is the respective rotation at a predetermined constant speed of a photoconductive drum 201 and the transfer belt 217 by driving of the drum motor 322 and the belt motor 321. The image formation preparation is processing in which an image forming unit transitions into a state in which formation of a toner image is possible, and for example, includes starting to output a charging bias and a developing bias. Image formation is an operation from the start of laser beam irradiation until primary transfer. The primary transfer is a transfer of a toner image from the photoconductive drum 201 to the transfer belt 217.

The CPU 301, when it receives a job, feeds a sheet in the cassette 101 by rotating the pickup roller 102. Meanwhile, the CPU 301 starts image formation preparation and image formation so that a toner image arrives at a secondary transfer unit when the sheet arrives at the secondary transfer unit.

Contact/Separation Operations

Before image formation preparation, the CPU 301 executes the contact operation or the separation operation for the transfer belt 217. If an image to be formed according to the job (target image) is a color image, the CPU 301 moves the positioning members 214 and 215 to the contact position.

Rotation Operation

The CPU 301 starts rotation of the photoconductive drums 201Y to 201K and the transfer belt 217. A rotation time To that is needed from when the photoconductive drum 201 and the transfer belt 217 start to rotate until they rotate at the predetermined constant speed is, for example, 200 milliseconds. Next, an image formation preparation is started in order starting with the photoconductive drum 201Y for yellow which is positioned most upstream in the direction in which the toner image is conveyed. The photoconductive drums 201M to 201K positioned downstream of the photoconductive drum 201Y start image formation preparation at respectively shifted timings. For example, the start timing of the photoconductive drum 201M is delayed by a predetermined duration from the start timing of the photoconductive drum 201Y. The predetermined duration is the time that can be obtained by dividing a conveyance distance on the transfer belt 217 from the primary transfer position of the photoconductive drum 201Y to the primary transfer position of the photoconductive drum 201M by the conveyance speed. For example the predetermined duration is 300 milliseconds. In the color mode, it becomes possible to form images of all four colors 900 milliseconds from the completion of the image formation preparation for yellow. On the other hand, if the target image is a monochrome image, the CPU 301 moves the positioning members 214 and 215 to the separated position. By this, the photoconductive drums 201Y to 201C and the transfer belt 217 are separated. The time that it takes for the positioning members 214 and 215 to move from the contact position to the separated position is, for example, 900 milliseconds. Then, the CPU 301 rotates the photoconductive drum 201K and the transfer belt 217, and starts image formation preparation for only black out of yellow, magenta, cyan, and black.

Image Formation Preparation

Representative description of image formation preparation for yellow will be given here, but the image formation preparation is similar for toner colors other than yellow. The CPU 301 outputs an instruction to the PWM unit 310Y, and applies a charging bias to the charging roller 202Y. By the photoconductive drum 201Y rotating, a region that has been sufficiently charged on the surface of the photoconductive drum 201Y will reach the developer 204Y. When the charge region reaches the developer 204Y, the CPU 301 outputs an instruction to the PWM unit 310Y, and applies a developing bias to the developer 204Y. Here, the time needed for the photoconductive drum 201Y to sufficiently charge from when the charging bias is applied to the charging roller 202Y is, for example, 100 milliseconds. Also, the time required for the charged region to move from the charging roller 202Y to the developer 204Y is, for example, 100 milliseconds. In other words, in total, 200 milliseconds are required for the image formation preparation. The time required for image formation preparation may be referred to as the preparation time Tp.

Image Formation

Representative description of image formation for yellow will be given here, but the image formation is similar for other toner colors. When image formation preparation completes, the CPU 301 outputs an image output instruction to the image processor 313. By the image processor 313 starting to output an image signal to the laser unit 203Y, the laser unit 203Y starts irradiating a laser beam. Thereby, a latent image is formed on the photoconductive drum 201Y. By the photoconductive drum 201Y rotating, the latent image arrives at the developer 204Y, and a latent image is developed by the yellow toner. By this, the toner image is formed. After that, the toner image on the photoconductive drum 201Y is conveyed to the primary transfer position for yellow. By the CPU 301 applying the primary transfer bias to the primary transfer roller 211Y, the toner image is transferred to the transfer belt 217.

Secondary Transfer

The secondary transfer is a transfer of a toner image from the transfer belt 217 to a sheet. The toner image that was transferred to the transfer belt 217 is conveyed to the secondary transfer unit by rotation of the transfer belt 217. The conveyance time Tt corresponding to the distance of a conveyance section from the primary transfer position of the photoconductive drum 201K to a secondary transfer position of the secondary transfer roller 120 is, for example, 300 milliseconds. By the CPU 301 applying the secondary transfer bias to the secondary transfer roller 120, the toner image is transferred to the sheet.

In a case where an image is formed on a plurality of sheets according to a job, the distance from a preceding image on the transfer belt 217 to a succeeding image is kept to a fixed distance (sheet interval). The time Ti corresponding to this sheet interval is a kind of wait period, and is, for example, 100 milliseconds. The reason that such a wait period is necessary is that a predetermined processing time is required to prepare the next image after the image processor 313 outputs an image.

<Mode Switching>

In a job for printing a plurality of pages, there are cases where monochrome images and color images are mixed. In such a case, it is necessary to switch from the monochrome mode to the color mode. Here, a job for forming a color image on two pages after forming a monochrome image on two pages is used as an example.

Figure 4A:
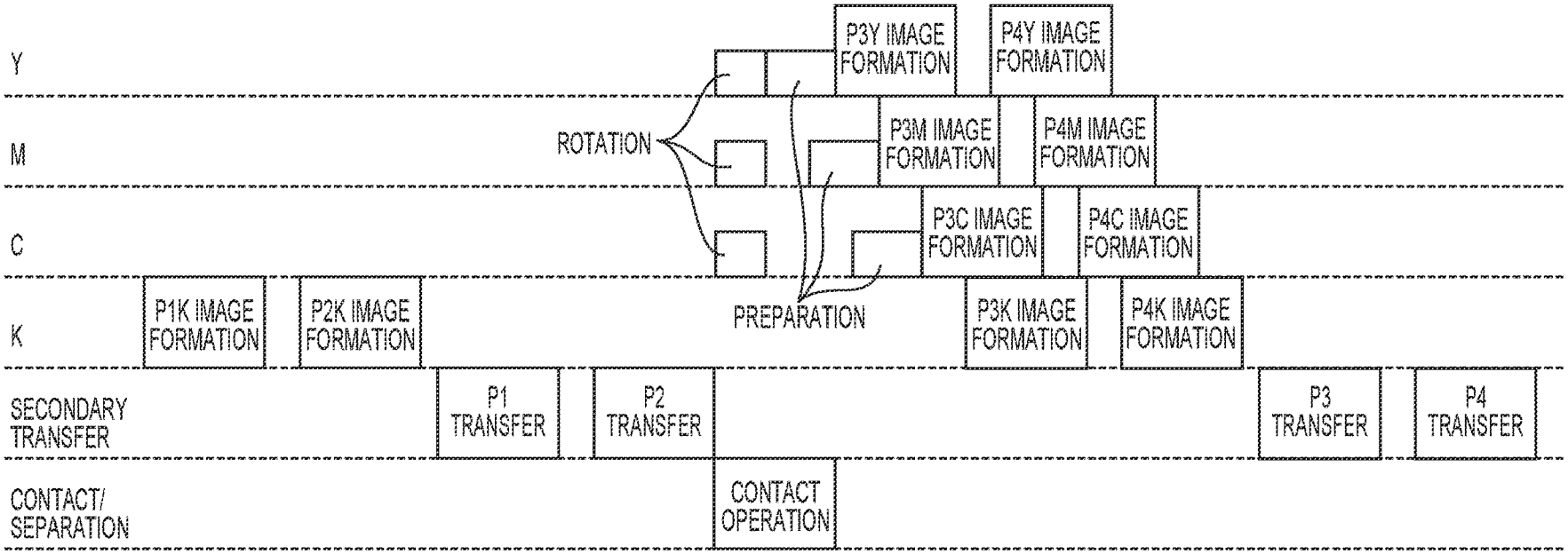
FIGS. 4A and 4B are views for describing a timing for switching from a monochrome mode to a color mode.

FIG. 4A illustrates a case in which mode switching (the contact operation) is executed after the two pages of monochrome images are formed. In FIG. 4A, P1K indicates a black-toner toner image of the first page. In other words, P1 to P4 indicate the pages, and Y, M, C, and K indicate the toner colors. Rotation operation is abbreviated to "rotation". Image formation preparation is abbreviated to "preparation". In particular, when the monochrome image of the second page is transferred to the sheet, the contact operation is started. Accordingly, a wasteful section in which the photoconductive drum 201K is rotating even though an operation for forming an image on the black photoconductive drum 201K is not being performed is present between the monochrome image of the second page and the color image of the third page. Such a wasteful section increases the waiting time for the user and leads to wasteful wear-and-tear on the various parts.

Figure 4B:
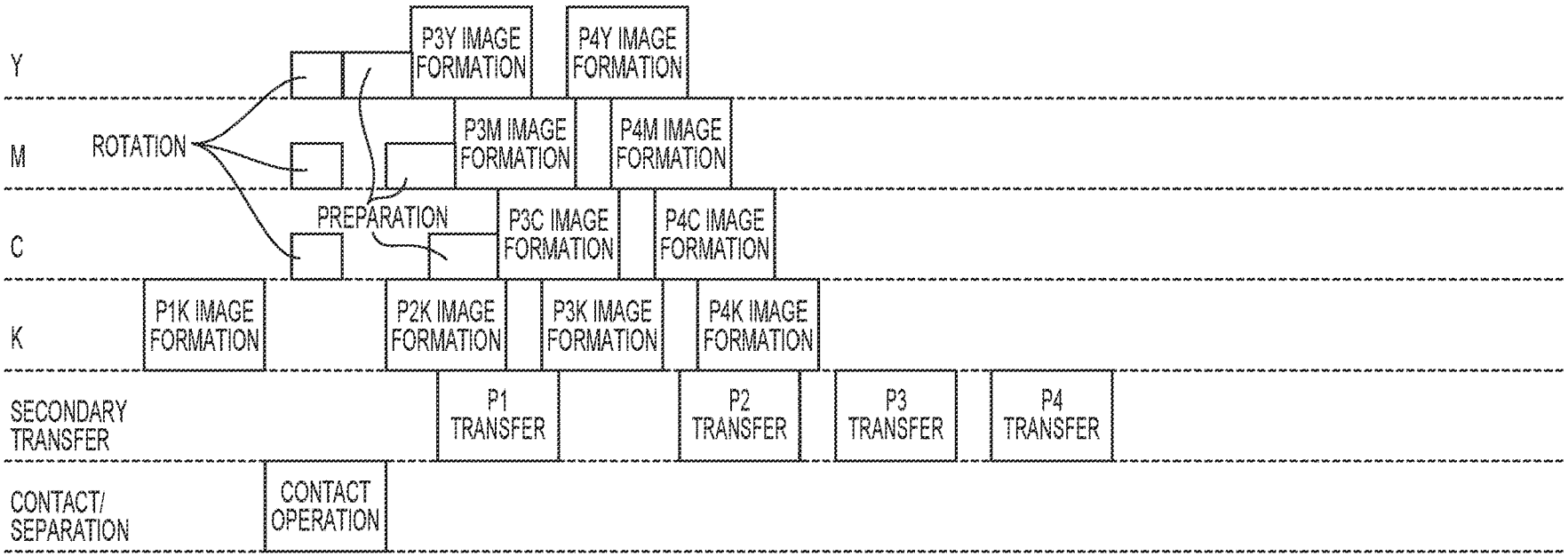

FIG. 4B illustrates a case in which formation of the monochrome image on the second page is caused to be delayed. Specifically, when formation of the monochrome image on the first page completes, the contact operation is executed. After that, formation of the monochrome image of the second page and the secondary transfer of the monochrome image of the first page are executed. Because the contact operation is executed in a state in which the monochrome image of the first page is present on the transfer belt 217, there is the possibility that an unevenness will occur in the monochrome image of the first page.

FIG. 4A is a timing chart indicating improved mode switching. In the present embodiment, the time corresponding to the distance from the primary transfer position of the photoconductive drum 201Y to the primary transfer position of the photoconductive drum 201K is referred to as Td. The time required for the contact operation is referred to as Ts. For example, Td is 900 milliseconds, Tt is 300 milliseconds, To is 200 milliseconds, Tp is 200 milliseconds, Ti is 100 milliseconds, and Ts is 900 milliseconds. Note that the present invention is not limited to these numerical values. Tk is the time corresponding to the length of the image.

Figure 5:
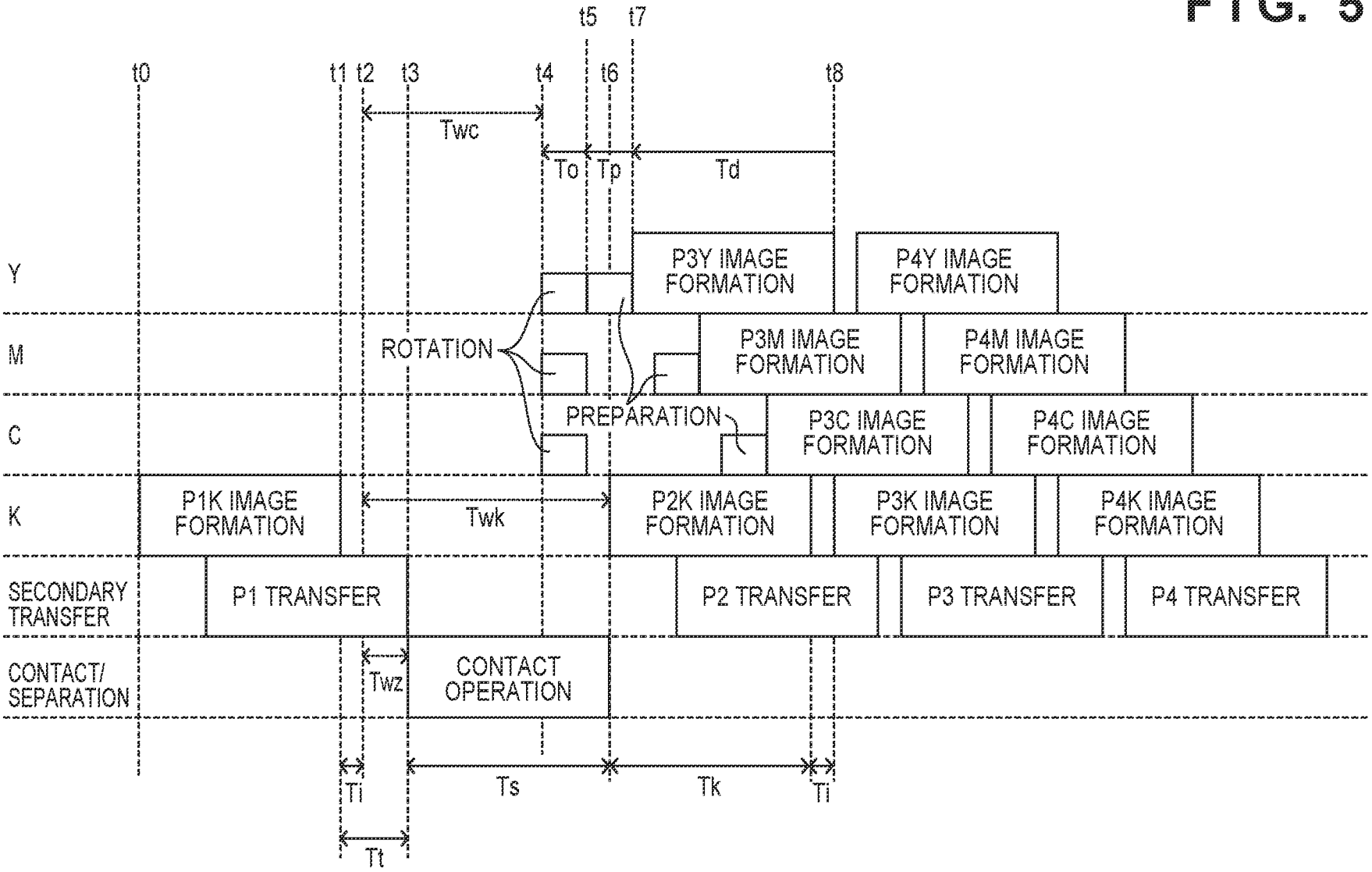
FIG. 5 is a view for describing a timing for switching from the monochrome mode to the color mode.

As FIG. 5 illustrates, monochrome images are formed on the first page and the second page, and color images are formed on the third page and the fourth page. The monochrome image of the first page may be the first page of a job, and may be an intermediate page. For this reason, prior to time t0, at which formation of the monochrome image of the first page is started, rotation and image formation preparation are executed for the photoconductive drum 201K. However, assume that in the case where the monochrome image of the first page is an intermediate page, the transfer belt 217 is already in a separated state at the point in time at which the monochrome image of the first page is to be formed.

At the time t0, the CPU 301 starts image formation of the monochrome image of the first page.

At the time t1, the CPU 301 completes image formation of the monochrome image of the first page.

At the time t2, the CPU 301 executes a determination as to image formation for the monochrome image of the second page. Here, the time t2 is the time after Ti passes from the time t1. Because a plurality of color images continue after the monochrome image of the second page in this example, it is necessary to switch from the monochrome mode to the color mode. Here, as FIG. 4A illustrates, when image formation for the monochrome image of the second page is started prior to the contact operation, a wasteful time period will occur. Accordingly, at the time t2, the CPU 301 does not start image formation of the monochrome image of the second page, and executes scheduling so as to start the image formation of the second page at the time t6 when the contact operation has ended.

At the time t3, the CPU 301 completes the secondary transfer of the monochrome image of the first page, and starts the contact operation of the transfer belt 217. The time t3 is the time after Tt has elapsed from the time t1.

At the time t4, the CPU 301 executes the rotation operation for the photoconductive drums 201Y to 201C so that the photoconductive drums 201Y to 201C and the transfer belt 217 do not rub during the contact operation.

At the time t5, when the rotation operation of the photoconductive drums 201Y to 201C ends (a predetermined constant speed of rotation is reached), the CPU 301 starts image formation preparation for yellow for the color image of the third page. After a fixed time from the time t5, the CPU 301 starts the image formation preparation for magenta. After a fixed time thereafter, the CPU 301 starts the image formation preparation for cyan.

At the time t6, when the contact operation ends, the CPU 301 starts image formation of the monochrome image of the second page. The time t6 is the time after Ts passes from the time t3.

At the time t7, the image formation preparation for yellow for the color image of the third page ends, and the CPU 301 starts image formation for yellow. After a fixed time from the time t7, the CPU 301 starts the image formation for magenta. After a fixed time thereafter, the CPU 301 starts the image formation for cyan. After a fixed time thereafter, the CPU 301 starts the image formation for black.

At the time t8, image formation for yellow ends. The time t8 is the time after Tk+Ti passes from the time t6. In other words, the time t8 is the time after Tt+Ts+Tk+Ti passes from the time t1. Also, the time t8 is the time after Tt+Ts+Tk passes from the time t2.

Here, the problem is how to decide the time t4. The CPU 301 obtains the time t8 which is when Ti has elapsed from the time at which image formation of the monochrome image for the second page completes. Furthermore, the CPU 301 decides t4 to be the time going back a predetermined duration (Td+Tp+To) from the time t8. By deciding the time t4, in other words by starting the rotation operation of the photoconductive drums 201Y, 201M, and 201C in this way, it becomes possible to start image formation of the color image for the third page efficiently. Accordingly, at the time t2, the CPU 301 calculates the time difference (wait period Twc) with respect to the time t4.

<Flowchart>

Figure 6:
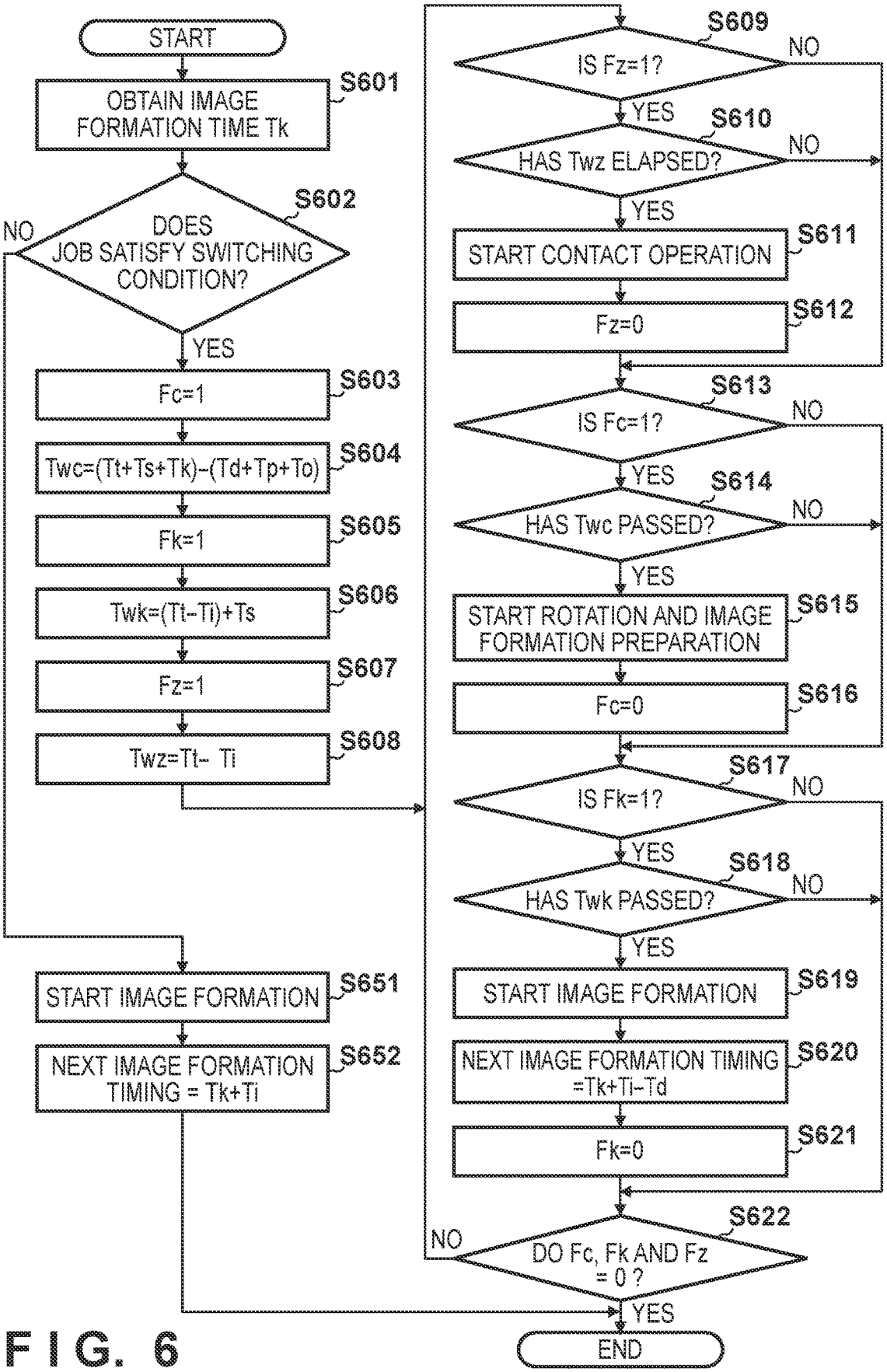
FIG. 6 is a flowchart for describing a determination to start image forming.

FIG. 6 illustrates the determination as to the start of image formation that the CPU 301 executes. The start determination is executed upon image formation start timing for the color (head color) that is transferred to the transfer belt 217 first for each of the pages. Specifically, for the first page in the job, the start determination is executed at the timing at which the image formation preparation completes for the head color. Also, for intermediate pages of the job, the start determination is executed at the timing at which the wait period Ti has elapsed from when image formation for the head color of the preceding page completes. By the start determination, it is decided whether to start image formation of the determination target page immediately or to delay the start of image formation for the mode switch.

In step S601, the CPU 301 analyzes the job, obtains the length of the image in the sheet conveyance direction, and converts that length into the image formation time Tk. For example, the CPU 301 may calculate the image formation time Tk by dividing the length by the conveyance speed (image forming speed). Below, the i-th page is referred to as Pi, and the i+1-th page is referred to as Pi+1. Note that Pi indicates the page that is the target of the determination.

In step S602, the CPU 301 determines whether or not the job satisfies the switching condition. The switching condition is a condition under which an operation for switching from the monochrome mode to the color mode is permitted. For example, the switching condition may be that the image of Pi is a monochrome image, and the image of Pi+1 is a color image. In the case where Pi is a color image or where Pi+1 is also a monochrome image, the CPU 301 advances the processing to step S651. In step S651, the CPU 301 starts image formation immediately (time tx). In step S652, the CPU 301 analyzes the job, and decides the time tx+1 which is the next image formation timing. For example, if Pi is a color image, the CPU 301 sets the start timing for image formation for the next color for Pi to the timing at which Tk+Ti has elapsed from the time tx. If Pi+1 is a monochrome image, the CPU 301 sets the start timing for image formation for black to the timing at which Tk+Ti has elapsed from the time tx. Specifically, step S651 and step S652 are applied for the monochrome image of the first page, the color image of the third page, and the color image of the fourth page. When the next image formation timing arrives, the CPU 301 executes step S601 again. Meanwhile, when it is determined in step S602 that the image of Pi is a monochrome image and the image of Pi+1 is a color image, the CPU 301 advances the processing to step S603. For example, for the monochrome image P2K of the second page, the CPU 301 advances the processing to step S603.

In step S603, the CPU 301 sets a wait flag Fc to 1. The wait flag Fc is a flag that indicates whether or not the state is such that image formation preparation for a color image is being awaited.

In step S604, the CPU 301 decides a color image preparation wait period Twc. The preparation wait period Twc is a period over which to wait for the start of the rotation operation for the photoconductive drum 201. As FIG. 5 illustrates, the time at which the rotation operation for the yellow image P3Y is started is t4. Also, the start determination is executed at the time t2. In other words, the preparation wait period Twc is the time from the time t2 to the time t4.

$$Twc=(Tt+Ts+Tk)-(Td+Tp+To) \quad (1)$$

In step S605, the CPU 301 sets a wait flag Fk to 1. The wait flag Fk is a flag that indicates whether or not the state is such that image formation preparation for a monochrome image is being awaited.

In step S606, the CPU 301 decides a monochrome image preparation wait period Twk. As FIG. 5 illustrates, the time at which image formation for the monochrome image P2K is started is t6. Thus, the preparation wait period Twk is the time from the time t2 to the time t6. Note that the time t6 is the end time of the contact operation.

$$Twk=(Tt-Ti)+Ts \quad (2)$$

In step S607, the CPU 301 sets a wait flag Fz to 1. The wait flag Fz is a flag indicating whether or not the state is such that execution of the contact operation is being awaited. If the wait flag Fz is 1, the CPU 301 is waiting for execution of the contact operation.

In step S608, the CPU 301 decides the contact wait period Twz. As FIG. 5 illustrates, the time at which the contact operation is started is t3. Thus, the contact wait period Twz is the time from the time t2 to the time t3.

$$Twz=Tt-Ti \quad (3)$$

In step S609, the CPU 301 determines whether or not the current state is a state in which the contact operation is being awaited, in other words whether or not the wait flag Fz is 1. When the time t3 arrives and the wait flag Fz is 0, the CPU 301 advances the processing to step S613. Meanwhile, when the time t3 has not arrived and the wait flag Fz is 1, the CPU 301 advances the processing to step S610.

In step S610, the CPU 301 determines whether or not the time t3 at which to start the contact operation has arrived, in other words whether or not the contact wait period Twz has elapsed from the time t2. The CPU 301 has a timer or a counter, and counts the elapsed time from the time t2. The CPU 301 may determine whether or not the start time t3 has arrived by comparing the count value and the contact wait period Twz. If the start time t3 has not arrived, the CPU 301 advances the processing to step S613. Meanwhile, if the start time t3 has arrived, the CPU 301 advances the processing to step S611.

In step S611, the CPU 301 starts the contact operation by rotating the contact/separation motor 323 in the direction for contact. By this, the positioning members 214 and 215 move to the contact position, and the photoconductive drums 201Y, 201M, and 201C come into contact with the transfer belt 217. In step S612, the CPU 301 resets the wait flag Fz to 0.

In step S613, the CPU 301 determines whether or not the current state is a state in which image formation preparation for a color image is being awaited, in other words whether or not the wait flag Fc is 1. When the time t4 arrives and the wait flag Fc is 0, the CPU 301 advances the processing to step S617. Meanwhile, when the time t4 has not arrived and the wait flag Fc is 1, the CPU 301 advances the processing to step S614.

In step S614, the CPU 301 determines whether or not the time t4 at which to start the rotation operation has arrived, in other words whether or not the contact wait period Twc has elapsed from the time t2. The CPU 301 has a timer or a counter, and counts the elapsed time from the time t2. The CPU 301 may determine whether or not the start time t4 has arrived by comparing the count value and the contact wait period Twc. If the start time t4 has not arrived, the CPU 301 advances the processing to step S617. Meanwhile, if the start time t4 has not arrived, the CPU 301 advances the processing to step S615.

In step S615, the CPU 301 starts the rotation operation and the image formation preparation. The CPU 301 activates the drum motors 322Y, 322M, and 322C, and controls the rotation speed of the photoconductive drums 201Y, 201M, and 201C to be a target speed. When the rotation operation completes, the CPU 301 starts outputting the charging bias and outputting the developing bias by causing the PWM units 310Y, 310M, and 310C to operate.

In step S616, the CPU 301 resets the wait flag Fc to 0 because the rotation operation and the image formation preparation have completed.

In step S617, the CPU 301 determines whether or not the current state is a state in which image formation preparation for a monochrome image is being awaited, in other words whether or not the wait flag Fk is 1. When the time t6 arrives and the wait flag Fk is 0, the CPU 301 advances the processing to step S622. Meanwhile, when the time t6 has not arrived and the wait flag Fk is 1, the CPU 301 advances the processing to step S618.

In step S618, the CPU 301 determines whether or not the time t6 at which to start image formation for the monochrome image has arrived, in other words whether or not the wait period Twk has elapsed from the time t2. The CPU 301 has a timer or a counter, and is counting the elapsed time from the time t2. The CPU 301 may determine whether or not the start time t6 has arrived by comparing the count value and the contact wait period Twk. If the start time t6 has not arrived, the CPU 301 advances the processing to step S622. Meanwhile, if the start time t6 has arrived, the CPU 301 advances the processing to step S619.

In step S619, the CPU 301 starts image formation for the monochrome image by making an instruction for the output of an image signal for the monochrome image to the image processor 313. The image processor 313 outputs the image signal for the monochrome image to the laser unit 203K.

In step S620, the CPU 301 decides the next image formation timing, in other words the time t7. As FIG. 5 illustrates, the image formed next is the yellow image P3Y. The elapsed time Twx from the time t6 until the time t7 is obtained by the following expression. The CPU 301 again executes the sequence of processes from step S601 when the time t7 arrives.

$$Twx=Tk+Ti-Td \quad (4)$$

In step S621, the CPU 301 resets the wait flag Fk to 0. In step S622, the CPU 301 determines whether or not all of the wait flags Fc, Fk, and Fz are 0. If not all of the wait flags Fc, Fk, and Fz are 0, the CPU 301 advances the processing to step S609. On the other hand, if all of the wait flags Fc, Fk, and Fz are 0, the CPU 301 ends the start determination. In this way, the start determination is continued until all of the three processes—the contact operation, color image forming preparation, and monochrome image forming have started. If all three processes have been started, the start determination ends.

By virtue of this embodiment, the contact operation is executed after the secondary transfer ends for a preceding monochrome image (P1K). For this reason, the contact operation is executed in a period of time in which there is no toner image on the transfer belt 217 and in which image formation is not being executed for any of the photoconductive drums 201. Thus, displacement of the position at which to form an image, color misregistration, image unevenness, or the like due to the contact operation tends not to occur. Also, the rotation operations for the photoconductive drums 201Y to 201C for a color image are executed while the contact operation is being executed, and so it is possible to start formation of the monochrome image immediately when the contact operation ends. In other words, the monochrome image tends not to be influenced by the rotation of the photoconductive drums 201Y to 201C. Since the contact operation and the rotation operation are executed in parallel, the waiting time is shortened. Also, by delaying the formation timing for a monochrome image (P2K) which is formed immediately prior to a color image, it is possible to execute formation of the monochrome image and formation of the color image in parallel. Also, when FIG. 5 and FIG. 4A are compared, the period of time in which image formation to the photoconductive drum 201K is not being executed in FIG. 5 is shortened. In other words, a wasteful time period is significantly reduced. Furthermore, by virtue of this embodiment, the time t4 and the like are decided in accordance with the image formation time Tk which corresponds to the length of the monochrome image. Also, the time t4 and the like are decided considering the time Tt which corresponds to the distance of the section from the photoconductive drum 201K to the secondary transfer roller 120. In this case, restriction on the length of the image and restriction on the length of this section are relaxed. In other words, it is possible to apply the image forming control of the present embodiment to image forming apparatuses of various configurations.

<Summary>

As FIG. 1 illustrates, the photoconductive drum 201Y is an example of a first image formation unit for forming a toner image by a first color. The photoconductive drum 201M is an example of a second image formation unit for forming a toner image by a second color. The photoconductive drum 201C is an example of a third image formation unit for forming a toner image by a third color. The photoconductive drum 201K is an example of a fourth image formation unit for forming a toner image by a fourth color. The transfer belt 217 is an example of an intermediate transfer member onto which toner images formed by each of the first image formation unit, the second image formation unit, the third image formation unit, and the fourth image formation unit are transferred, and for conveying the toner images to a transfer position at which to transfer the toner images to a sheet. The contact/separation motor 323 and the positioning members 214 and 215 are examples of a contact and separation mechanism for causing the first image formation unit, the second image formation unit, and the third image formation unit to contact and to separate with respect to the intermediate transfer member. In other words, the contact/separation motor 323 and the positioning members 214 and 215 are an example of a contact and separation mechanism for switching a contact state in which the first image formation unit, the second image formation unit, and the third image formation unit are in contact with the intermediate transfer member and a separated state in which they are separated. The controller 300 is an example of a controller for controlling the first image formation unit, the second image formation unit, the third image formation unit, the fourth image formation unit, and the contact and separation mechanism. As FIG. 1 illustrates, the first image formation unit is provided most upstream in the direction in which the toner images are conveyed by the intermediate transfer member. The second image formation unit is provided downstream of the first image formation unit in the direction. The third image formation unit is provided downstream of the second image formation unit in the direction. The fourth image formation unit is provided downstream of the third image formation unit in the direction. The controller 300 inputs a job for forming a first image which is a monochrome image, a second image which is a monochrome image, a third image which is a color image, and a fourth image which is a color image in order on sheets. In such a case, the controller 300 controls the fourth image formation unit to execute the contact operation after formation of the first image completes and transfer to the sheet by the intermediate transfer member completes, and prior to starting formation of the second image. In other words, the controller 300 controls the contact and separation mechanism to cause the first image formation unit, the second image formation unit, and the third image formation unit to contact with respect to the intermediate transfer member. In other words, the controller 300 forms the first image by the fourth image formation unit in the separated state. The controller 300 controls the contact and separation mechanism to switch to the contact state after formation of the first image completes and transfer to the sheet by the intermediate transfer member completes, and prior to starting formation of the second image. Furthermore, the controller 300 executes formation of the second image by the fourth image formation unit, and formation of the third image by the first image formation unit. In this way, the contact operation is executed in a period of time from the timing at which the secondary transfer of a preceding monochrome image ends until the timing at which image formation of the succeeding monochrome image is started. Accordingly, no wasteful time period occurs in a period of time for switching from the monochrome mode to the color mode. Also, a toner image is not present on the intermediate transfer member during the contact operation. For this reason, the toner image on the intermediate transfer member is not disturbed. Also, none of the image forming units is executing image formation during the contact operation. For this reason, the toner images in the image forming units are not disturbed.

As FIG. 5 illustrates, the controller 300 may execute formation of the second image by the fourth image formation unit, and formation of the third image by the first image formation unit, and the second image formation unit in parallel. Consequently, it becomes possible to efficiently successively form a monochrome image and a color image. The controller may execute formation of the second image by the fourth image formation unit, and formation of the third image by the first image formation unit, the second image formation unit, and the third image formation unit in parallel.

As FIG. 5 illustrates, a first distance which is a total of an interval between images that are adjacent on the intermediate transfer member and the length of the second image may be longer than a second distance which is a distance between a contact position between the first image formation unit and the intermediate transfer member and a contact position between the fourth image formation unit and the intermediate transfer member. In other words, the sum of the time Ti corresponding to a sheet-to-sheet interval and a time Tk corresponding to the length of the second image may be longer than a time Td corresponding to the distance between the contact position between the first image formation unit and the intermediate transfer member and the contact position between the fourth image formation unit and the intermediate transfer member. In such a case, the controller 300 delays the time t7 at which to start formation of the third image after the time t6 at which to start formation of the second image by a time corresponding to the difference between the first distance and the second distance or more. This time corresponds to Tk+Ti−Td.

As FIG. 5 illustrates, the controller 300 decides the time t2 at which the time Ti, which corresponds to the interval between adjacent images, has elapsed from the time t1 at which the fourth image formation unit ends formation of the first image to be a starting point. Furthermore, the controller 300 starts the contact operation at the time t3 at which a time which is a difference between the time Tt, which corresponds to the distance between the contact position between the fourth image formation unit and the intermediate transfer member and the transfer position of the intermediate transfer member, and the time Ti which corresponds to the interval between adjacent images has elapsed with the time t2 as the starting point. In other words, the controller 300 controls the contact and separation mechanism so as to switch to the contact state. By this, the contact and separation mechanism causes the first image formation unit, the second image formation unit, and the third image formation unit to contact with respect to the intermediate transfer member.

The first image formation unit to the fourth image formation unit may each comprise a photosensitive member. As FIG. 5 illustrates, the controller 300 starts a rotation operation of the photosensitive member of the first image formation unit in order to form the third image at the time t4 at which the first wait period Twc has elapsed from the time t2 which is the starting point. The controller 300 obtains a first sum which is a sum of the time Tt, which corresponds to the distance between the contact position between the fourth image formation unit and the intermediate transfer member and the transfer position of the intermediate transfer member, the time Ts required for the contact operation of the intermediate transfer member, and the time Tk which corresponds to the length of the second image. Furthermore, the controller 300 obtains a second sum which is a sum of the time Td corresponding to the length of the third image, the time To required for the rotary member of the first image formation unit to get to a predetermined constant speed rotation, and the time Tp required for the image formation preparation of the first image formation unit. Furthermore, the controller 300 may obtain the first wait period Twc by subtracting the second sum from the first sum.

The time To required for a rotation operation is the time required from when rotation of the rotary member of the first image formation unit starts until the rotary member rotates at the predetermined constant speed. Also, the image formation preparation includes starting to output the charging bias and the developing bias in the first image formation unit.

As FIG. 5 illustrates, the controller 300 causes the fourth image formation unit to start formation of the second image at the time t6 at which a second wait period Twk has elapsed from the starting point. The controller 300 obtains a sum of the time Tt, which corresponds to the distance between the contact position between the fourth image formation unit and the intermediate transfer member and the transfer position of the intermediate transfer member, and the time Ts required for the contact operation of the intermediate transfer member. Furthermore, the controller 300 may calculate the second wait period Twk by subtracting the time Ti corresponding to the interval between adjacent images from this sum.

The transfer belt 217 is an endless belt. As FIG. 2A and FIG. 2B illustrate, the contact and separation mechanism changes the respective positions of a first transfer member, a second transfer member, and a third transfer member which contact the inner surface of the endless belt from a separated position to a contact position. By this, the first transfer member, the second transfer member, and the third transfer member press the endless belt to the first image formation unit, the second image formation unit, and the third image formation unit. Note that the primary transfer rollers 211Y, 211M, and 211C are examples of the first transfer member, the second transfer member, and the third transfer member, respectively. In this way, the contact and separation mechanism switches to the separated state by causing a portion of the endless belt to separate from the first image formation unit, the second image formation unit, and the third image formation unit.

The contact/separation motor 323 is an example of a driving source of the contact and separation mechanism. The driving source may be a solenoid or the like. The positioning members 214 and 215 are an example of a positioning member for positioning the first image formation unit, the second image formation unit, and the third image formation unit between the contact position and the separated position. In other words, the positioning members 214 and 215 align the intermediate transfer member in the contact state and the separated state in relation to the first image formation unit, the second image formation unit, and the third image formation unit. By driving the driving source, the controller 300 changes the position of the positioning members in accordance with the driving source.

As FIG. 1 illustrates, the photoconductive drums 201Y to 201K are an example of n image forming units for forming toner images by respectively different colors. n is a natural number of 2 or more. The transfer belt 217 is an example of an intermediate transfer member that is provided so as to face the n image forming units, and to which toner images formed by the n image forming units are transferred, and that conveys the images. The secondary transfer roller 120 is an example of a transfer unit for transferring, to a sheet, an image that was transferred to the intermediate transfer member. The contact/separation motor 323 and the like is an example of a contact and separation mechanism that causes n−1 image forming units, out of the n image forming units, to contact and to separate with respect to the intermediate transfer member. In other words, the contact/separation motor 323 and the like switches between a contact state in which the n image forming units and the intermediate transfer member are in contact and a separated state in which n−1 image forming units excluding the image forming unit, out of the n image forming units, that is most downstream in the direction and the intermediate transfer member are separated. The controller 300 is a controller for controlling the monochrome mode and the full color mode. In other words, the controller 300 is an example of a controller for controlling a monochrome mode which is the separated state for forming a monochrome image, and a full color mode which is the contact state for forming a color image. The monochrome mode is a mode in which the n−1 image forming units and the intermediate transfer member are separated, and only the image forming unit provided downstream of the n−1 image forming units in the direction of conveyance of images by the intermediate transfer member is in contact with the intermediate transfer member. The full color mode is a mode in which all of the n image forming units contact the intermediate transfer member. The controller 300 may input a job for forming, in order, a first monochrome image, a second monochrome image, and a first color image and a second color image formed by overlapping two or more color images. In such a case, the controller 300 executes a contact operation after the first monochrome image is formed by the most downstream image forming unit in the separated state and transferred to a sheet by the transfer unit, and prior to formation of the second monochrome image by the most downstream image forming unit is started. In other words, the controller 300 controls the contact and separation mechanism so as to switch to the contact state. In this way, the controller 300 controls the contact and separation mechanism to cause the n−1 image forming units and the intermediate transfer member to be in contact. When contact between the n image forming units and the intermediate transfer member completes, the controller 300 executes formation of the second monochrome image by the most downstream image forming unit and formation of a toner image of a first color that is a basis of the first color image by the image forming unit positioned most upstream in the n image forming units. The toner image of the first color that is the basis for the first color image is a first color toner image for the first color image.

Other Embodiments

Embodiment(s) of the present invention can also be realized by a computer of a system or apparatus that reads out and executes computer executable instructions (e.g., one or more programs) recorded on a storage medium (which may also be referred to more fully as anon-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-016694, filed Feb. 1, 2018, which is hereby incorporated by reference herein in its entirety.

What is claimed is:

1. An image forming apparatus operable to form an image on a cut sheet, the apparatus comprising:

a first image formation unit configured to form a toner image by toner of a first color;

a second image formation unit configured to form a toner image by toner of a second color;

a third image formation unit configured to form a toner image by toner of a third color;

a fourth image formation unit configured to form a toner image by toner of a fourth color;

an intermediate transfer member onto which toner images formed by each of the first image formation unit, the second image formation unit, the third image formation unit, and the fourth image formation unit are transferred, and configured to convey the toner images to a transfer position at which the toner images are transferred to a cut sheet;

a contact and separation unit configured to switch between a contact state in which the intermediate transfer member is in contact with the first image formation unit, the second image formation unit, and the third image formation unit and a separated state in which the intermediate transfer member is separated from the first image formation unit, the second image formation unit, and the third image formation unit; and a controller that controls the first image formation unit, the second image formation unit, the third image formation unit, the fourth image formation unit, and the contact and separation unit such that image formation is effected in the separation state in a monochrome mode and image formation is effected in the contact state in a full color mode, wherein the first image formation unit is provided most upstream with respect to a conveyance direction in which the toner images are conveyed by the intermediate transfer member, the second image formation unit is provided downstream of the first image formation unit in the conveyance direction, the third image formation unit is provided downstream of the second image formation unit in the conveyance direction, the fourth image formation unit is provided downstream of the third image formation unit in the conveyance direction, in a case in which, after a first image, which is a monochrome image, is formed in the monochrome mode, a second image, which is a monochrome image, and a third image, which is a color image, are formed in order, the controller executes a mode switch control which switches to the contact state after formation of the first image completes and transfer to the cut sheet by the intermediate transfer member completes and prior to starting formation of the second image, and executes formation of the second image by the fourth image formation unit and formation of the third image by the first image formation unit in the full color mode, and the controller executes formation of the second image by the fourth image formation unit, and formation of the third image by the first image formation unit and the second image formation unit in parallel.

2. The image forming apparatus according to claim 1, wherein the controller executes formation of the second image by the fourth image formation unit, and formation of the third image by the first image formation unit, the second image formation unit, and the third image formation unit in parallel.

3. The image forming apparatus according to claim 1, wherein in a case in which a first distance which is a total of an interval between images that are adjacent on the intermediate transfer member and the length of the second image is longer than a second distance which is a distance between a contact position between the first image formation unit and the intermediate transfer member and a contact position between the fourth image formation unit and the intermediate transfer member, the controller delays the start of formation of the third image after the start of formation of the second image by a time corresponding to the difference between the first distance and the second distance or more.

4. The image forming apparatus according to claim 3, wherein the controller makes a timing at which a time, which corresponds to an interval between adjacent images, has elapsed from a timing at which the fourth image formation unit ends formation of the first image be a starting point, and controls the contact and separation unit to switch to the contact state when a time which is a difference between a time, which corresponds to the distance between the contact position between the fourth image formation unit and the intermediate transfer member and the transfer position of the intermediate transfer member, and the time which corresponds to the interval between the adjacent images has elapsed from the starting point.

5. The image forming apparatus according to claim 4, wherein the first image formation unit to the fourth image formation unit each comprises a photosensitive member, the controller starts a rotation operation of the photosensitive member of the first image formation unit in order to form the third image at the timing at which a first wait period elapses from the starting point, and the first wait period is obtained by subtracting a sum of a time corresponding to a length of the third image, a time required for a photosensitive member of the first image formation unit to reach a predetermined constant speed rotation, and a time required for the image formation preparation of the first image formation unit from a sum of a time corresponding to a distance between the contact position between the fourth image formation unit and the intermediate transfer member and the transfer position of the intermediate transfer member, a time required for the contact operation of the intermediate transfer member, and a time corresponding to the length of the second image.

6. The image forming apparatus according to claim 4, wherein the controller starts formation of the second image in the fourth image formation unit at a timing at which a second wait period elapses from the starting point, and the second wait period is obtained by subtracting a time corresponding to an interval between the adjacent images from a sum of a time corresponding to a distance between the contact position between the fourth image formation unit and the intermediate transfer member and the transfer position of the intermediate transfer member and a time required for the contact operation of the intermediate transfer member.

7. The image forming apparatus according to claim 1, wherein the controller starts an image formation preparation of the first image formation unit to form the third image before the fourth image formation unit starts forming the second image.

8. The image forming apparatus according to claim 7, wherein the first image formation unit includes a photosensitive member on which an electrostatic latent image is formed, a charger that charges the photosensitive member, and a developing unit that develops the electrostatic latent image, and the image formation preparation includes starting to output a charging bias for the charger and a developing bias for the developing unit in the first image formation unit.

9. The image forming apparatus according to claim 1, wherein the intermediate transfer member is an endless belt, and the contact and separation unit switches to the separated state by causing a portion of the endless belt to separate from the first image formation unit, the second image formation unit, and the third image formation unit.

10. The image forming apparatus according to claim 9, wherein the contact and separation unit comprises:

a driving source, and a positioning member that aligns the intermediate transfer member in the contact state and the separated state in relation to the first image formation unit, the second image formation unit, and the third image formation unit, and the control unit changes the position of the positioning member by the driving source.

11. An image forming apparatus operable to form an image on a cut sheet, the apparatus comprising:

a first image formation unit configured to form a toner image by toner of a first color;

a second image formation unit configured to form a toner image by toner of a second color;

a third image formation unit configured to form a toner image by toner of a third color;

a fourth image formation unit configured to form a toner image by toner of a fourth color;

an intermediate transfer member onto which toner images formed by each of the first image formation unit, the second image formation unit, the third image formation unit, and the fourth image formation unit are transferred, and configured to convey the toner images to a transfer position at which the toner images are transferred to a cut sheet;

a contact and separation unit configured to switch between a contact state in which the intermediate transfer member is in contact with the first image formation unit, the second image formation unit, and the third image formation unit and a separated state in which the intermediate transfer member is separated from the first image formation unit, the second image formation unit, and the third image formation unit; and a controller that controls the first image formation unit, the second image formation unit, the third image formation unit, the fourth image formation unit, and the contact and separation unit such that image formation is effected in the separated state in a monochrome mode and an image formation is effected in the contact state in a full color mode, wherein the first image formation unit is provided most upstream with respect to a conveyance direction in which the toner images are conveyed by the intermediate transfer member, the second image formation unit is provided downstream of the first image formation unit in the conveyance direction, the third image formation unit is provided downstream of the second image formation unit in the conveyance direction, the fourth image formation unit is provided downstream of the third image formation unit in the conveyance direction, in a case in which, after a first image, which is a monochrome image, is formed in the monochrome mode, a second image, which is a monochrome image, and a third image, which is a color image, are formed in order, the controller executes a mode switch control which switches to the contact state after formation of the first image completes, and prior to transfer to the cut sheet by the intermediate transfer member starts and starting formation of the second image, and executes formation of the second image by the fourth image formation unit and formation of the third image by the first image formation unit in the full color mode, and the controller executes formation of the second image by the fourth image formation unit and transfer of the first image in parallel.

* * * * *